US008430171B2

(12) United States Patent
Cochrane

(10) Patent No.: US 8,430,171 B2
(45) Date of Patent: Apr. 30, 2013

(54) METHOD AND ARRANGEMENT FOR SEALING A SUBSEA OIL WELLHEAD

(76) Inventor: David Robb Cochrane, Sint Job int Goor (BG)

( * ) Notice: Subject to any disclaimer, the term of this patent is extended or adjusted under 35 U.S.C. 154(b) by 66 days.

(21) Appl. No.: 12/828,696

(22) Filed: Jul. 1, 2010

(65) Prior Publication Data

US 2012/0000666 A1 Jan. 5, 2012

(51) Int. Cl.
*E21B 7/12* (2006.01)

(52) U.S. Cl.
USPC ..... 166/363; 166/364; 166/356; 166/75.13

(58) Field of Classification Search ..... 166/92.1, 166/79.1, 95.1, 97.1, 85.1, 85.3, 363–364, 166/356, 75.13, 75.14; 114/44, 45, 50, 51; 414/137.5, 138.2–138.4; 405/158, 166
See application file for complete search history.

(56) References Cited

U.S. PATENT DOCUMENTS 7,637,325 B2 * 12/2009 Goonetilleke et al. ..... 166/368

* cited by examiner

*Primary Examiner* — Thomas A Beach
*Assistant Examiner* — Aaron Lembo
(74) *Attorney, Agent, or Firm* — Oppedahl Patent Law Firm LLC

(57) ABSTRACT

Several, preferably three, deflection elements are placed and fixed around the wellhead, preferably in equal circumferential distances around the wellhead. For each deflection element a guiding cable is lowered with its head end from one or several, preferably three workspaces in the direction of the wellhead. Each guiding cable is looped with its head end through the corresponding deflection element, wherein each deflection element forms a point of reversal. Each guiding cable is pulled back with its head end side to the corresponding workspace while in return additional guiding cable is supplied and passed through the corresponding deflection element. A sealing element which is fastened to each guiding cable is lowered in the direction of the wellhead by pulling the guiding cables at their head end sides upwards and, in return, supplying the guiding cables in the direction of the wellhead on the lowering side. Later, the guiding cables are attached at a distance from each other around the sealing element, preferably attached at equal circumferential distances around the sealing element.

27 Claims, 2 Drawing Sheets

METHOD AND ARRANGEMENT FOR SEALING A SUBSEA OIL WELLHEAD

FIELD OF THE INVENTION

The invention relates to a method and a wellhead sealing arrangement for sealing a sub-sea oil and/or gas well at the wellhead. Offshore oil and gas recovery is a business with increasing importance as enormous oil resources are located offshore in the sea sediments of coastal regions. To make offshore oil fields accessible for explorations oil rigs have to be built and anchored offshore. From this oil rigs well drilling is carried out in the seabed. The seabed, however, often lies several hundred meters below the sea level so that sophisticated drilling technologies have to be applied to make the oil fields accessible.

However, activities as offshore drilling and offshore oil production face high risks. In case of an accident close to the wellhead it is difficult to get access to the borehole for repair work in order to avoid an uncontrolled spilling of oil and gas into the sea. Such an accident can e.g. be caused by a blowout, where gas escapes from the borehole under high pressure and damages the oil rig installation or even the device on the wellhead itself.

To prevent such a blowout, so-called blowout preventers are normally installed at the wellhead. This blowout preventers shall seal the wellhead in case of a blowout to avoid uncontrolled spill out of oil and gas. However, it still can happen that in case of a fierce blowout or an other damaging event the blowout preventer does not work or is destroyed. In such a case oil and gas spills out of the damaged bore hole in an uncontrolled manner.

There is very little experience about how to seal such a sub-sea borehole once all safety installation have failed. One problem is the position of the wellhead deep below the sea level on the seabed, which makes it difficult to access the wellhead for repair work. A second problem is the high pressure at which the oil or gas or a mixture of oil and gas escapes the bore hole. Because of this high pressure, the wellhead can not that easily capped by appropriate means.

DESCRIPTION OF THE INVENTION

It is therefore the object of the present invention to propose a method for sealing an opening of a sub-sea wellhead to stop the uncontrolled spill out of oil and/or gas through the opening, and a wellhead sealing arrangement to carry out this method.

The method according to the invention comprises the steps of:

- locating, i.e. placing and fixing, a loop-like deflection element close to the wellhead;
- lowering a guiding cable with its head end from a workspace above the wellhead, particularly above the sea level, in the direction of the wellhead;
- looping the guiding cable with its head end through the deflection element, wherein the deflection element forms a point of reversal; and
- pulling back the guiding cable with its head end to the workspace while in return additional guiding cable is supplied and passed through the deflection element;
- lowering a sealing element which is fastened on the guiding cable in direction of the well bead by pulling the guiding cable at its head end side upwards and supplying guiding cable in the direction of the wellhead on the lowering side;

- placing the sealing element on the opening of the wellhead by further pulling the guiding cable at its head end side and thereby sealing the borehole with the sealing element.

The guiding cable is slidably passed through the deflection element. In a preferred embodiment of the invention the point of reversal on the deflection element lies, when the sealing element is placed in its sealing position, lower or at the same height than the lowest fixing point of the guiding cable on the sealing element. In this way the sealing element can safely be placed on the wellhead as a vertical force can be exerted on the sealing element by means of the guiding cable attached on the sealing element till the sealing element is firmly positioned on, respectively in the wellhead.

The workspace can be a boat which is positioned directly or laterally displaced above the wellhead. The boat is preferably anchored once it has reached its operation position. However, the workspace can also be a working platform, as e.g. an offshore oil rig.

In order to place and fix the at lest one deflection element close to the wellhead an anchoring cable, on which the loop-like deflection element is fastened, is lowered from a workspace above the wellhead, particularly above the sea level, in direction of the wellhead. Subsequent, the anchoring cable is fastened on the wellhead, on another device near the wellhead or is anchored in the seabed close to the wellhead. By doing so, the deflection element is placed and fixed close to the wellhead. One or more anchoring elements can be placed and fixed close to the wellhead by means of one anchoring cable.

The loop-like deflection element is preferably a shackle. The anchoring cable and/or the guiding cable are preferably steel cables. The deflection element might alternatively be a sheave or pulley.

The anchoring cable is preferably taken down from the workspace to the wellhead by means of one or more remotely operated underwater vehicles (ROV). The fastening of the anchoring cable to the wellhead or to another device near the well head or the anchoring of the anchoring cable in the seabed and the placing and fixation of the deflection element close to the wellhead is preferably also carried out by the at least one ROV.

Furthermore, also the guiding cable can be taken down from the workspace to the wellhead by means of one or more remotely operated underwater vehicles (ROV). The ROV's can also be used to pass the guiding cable with its head end through the deflection element and to bring the guiding cable with its head end side back to the workspace.

In a preferred further development of the invention, not only one but two or more and most preferably three guiding cables are provided to take the sealing element down to the wellhead and to place it atop the wellhead.

For this several deflection elements, namely one deflection element for each guiding cable, are placed and fixed in distance to each other around the wellhead. The deflection elements are preferably located around the wellhead in equal circumferential distances.

As already described above in connection with one guiding cable, each guiding cable is lowered with its head end, i.e. taken down from the corresponding workspace to the wellhead. Afterwards each guiding cable is passed, i.e. looped, with its head end through the corresponding deflection element. Hence, each deflection element forms a point of reversal. Afterwards each guiding cable is pulled, i.e. brought back with its head end to the workspace while in return additional guiding cable is supplied on the lowering side and passed through the corresponding deflection element.

The sealing element is fastened to each guiding cable, wherein the guiding cables are affixed distanced from each other around the sealing element. The guiding cables are preferably affixed at equal circumferential distances around the sealing element. The term "around" means in this connection around the vertical axis of the sealing element in operating position. Basically this vertical direction corresponds to the direction of gravitation.

The application of two or more, preferably three guiding cables, allows the precise positioning of the sealing element above and in the wellhead. Particularly by using three or more guiding cables, the sealing element can be reliably placed and exactly aligned and hold above the wellhead despite of the out-flowing oil and gas.

The lowering of the sealing element is achieved by pulling the guiding cables on their head end side upwards and, in return, by supplying guiding cable in the direction of the wellhead on the lowering side. The positioning of the sealing element is achieved by applying a variable pulling force between the guiding cables. In this connection it is of course useful that the deflection elements are laterally displaced from the center of the wellhead, so that the orientation of the guiding cable section between the lowest fixing position on the sealing element and the deviating point on the deflection element has a vertical and horizontal component. However, the deflection elements should preferably not be located laterally too far-off in order to maintain a vertical component of orientation of said cable section which is not too small.

The guiding cables are preferably lowered form different workspaces, which are preferably boats or at least some of it are boats. The workspaces, i.e. the boats, are located above the sea level and are laterally displaced from the wellhead. Preferably each guiding cable is lowered from its own workspace. If three or more guiding cables are lowered from three or more workspaces to the wellhead, the workspaces are preferably arranged in a polygonal alignment around and laterally displaced from the wellhead, wherein the vertical axis which passes through the wellhead is preferably the geometrical center point of the polygonal structure.

Each guiding cable is preferably affixed to the sealing element in two positions, which are arranged on the sealing element above each other in a vertical direction of the sealing element in operation position. Hence, for every guiding cable at least a pair of fixing positions is provided at the sealing element. The fixing positions can e.g. be lugs on the sealing element on which the cable are attached. The pairs of fixing positions are arranged distanced from each other around the sealing element. They are preferable arranged equally distanced from each other in circumferential direction of the sealing element.

According to a preferred embodiment of the invention three guiding cables are provided, each of which is fastened to the sealing element on two positions which lie above each other in vertical direction, so that the sealing element can be guided and aligned via the six fastening positions, hence featuring six degrees of freedom. Basically, the guiding cable can also be interrupted, wherein a first end is fastened to a first fixing position and a second end is fastened on a second fixing position below the first fixing position of the sealing element.

The guiding cables are preferably pulled upwards on their head end side by means of a winch, located on the corresponding workspace. If the workspace is a boat floating on the sea, the winch is preferably a heave compensation winch in order to eliminate or reduce the effect of movement of the boat on the position and orientation of the sealing element.

The sealing element is preferably a plug, which is placed on the wellhead and at least partially inserted into the open hole or opening of the wellhead. The plug can be tapered towards the wellhead to achieve a wedge-effect when plugging the sealing element into the opening of the wellhead. The plug is preferably rounded, pointed or conical on the bottom facing the opening of the wellhead in order to evenly disperse the pressure coming from the wellhead. The opening may be, for example, a broken pipe at the wellhead or a blowout preventer, or at another location along a sub-sea manifold or a pipeline leading away from a wellhead.

In a further development of the invention the anchoring cable is a steel wire lasso which is placed, e.g. by means of one or more ROV, around the wellhead and pulled tight to the wellhead to build a locking loop. Onto the anchoring cable and preferably onto the locking loop one or more shackles are attached. It is also possible that for every shackle one separate anchoring cable, as above described, is applied. Furthermore, the deflection element, particularly the shackle, can also be pre-installed on the wellhead as a precautionary measurement during the installation of the wellhead device or the blowout preventer or another device on the wellhead.

The sealing element can be a closed plug which seals off the wellhead. However, it is also possible that the sealing element features a passage. On the passage of the sealing element outside the wellhead a pipe can be attached, so that, when the sealing element is in the sealing position on the wellhead, oil and/or gas can be discharged in a controlled manner through the plug. Of course the sealing element can be equipped with further features, e.g. anchoring means for anchoring the sealing element within the borehole, as e.g. an expandable screw in front of the sealing element.

BRIEF DESCRIPTION OF THE DRAWINGS

The subject matter of the invention will be explained in more detail in the following text with reference to preferred exemplary embodiments which are illustrated in the attached drawings, in which the following figures show.

The reference symbols used in the drawings, and their meanings, are listed in summary form in the list of reference symbols. In principle, identical parts are provided with the same reference symbols in the figures.

DETAILED DESCRIPTION OF PREFERRED EMBODIMENTS

Figure 1:
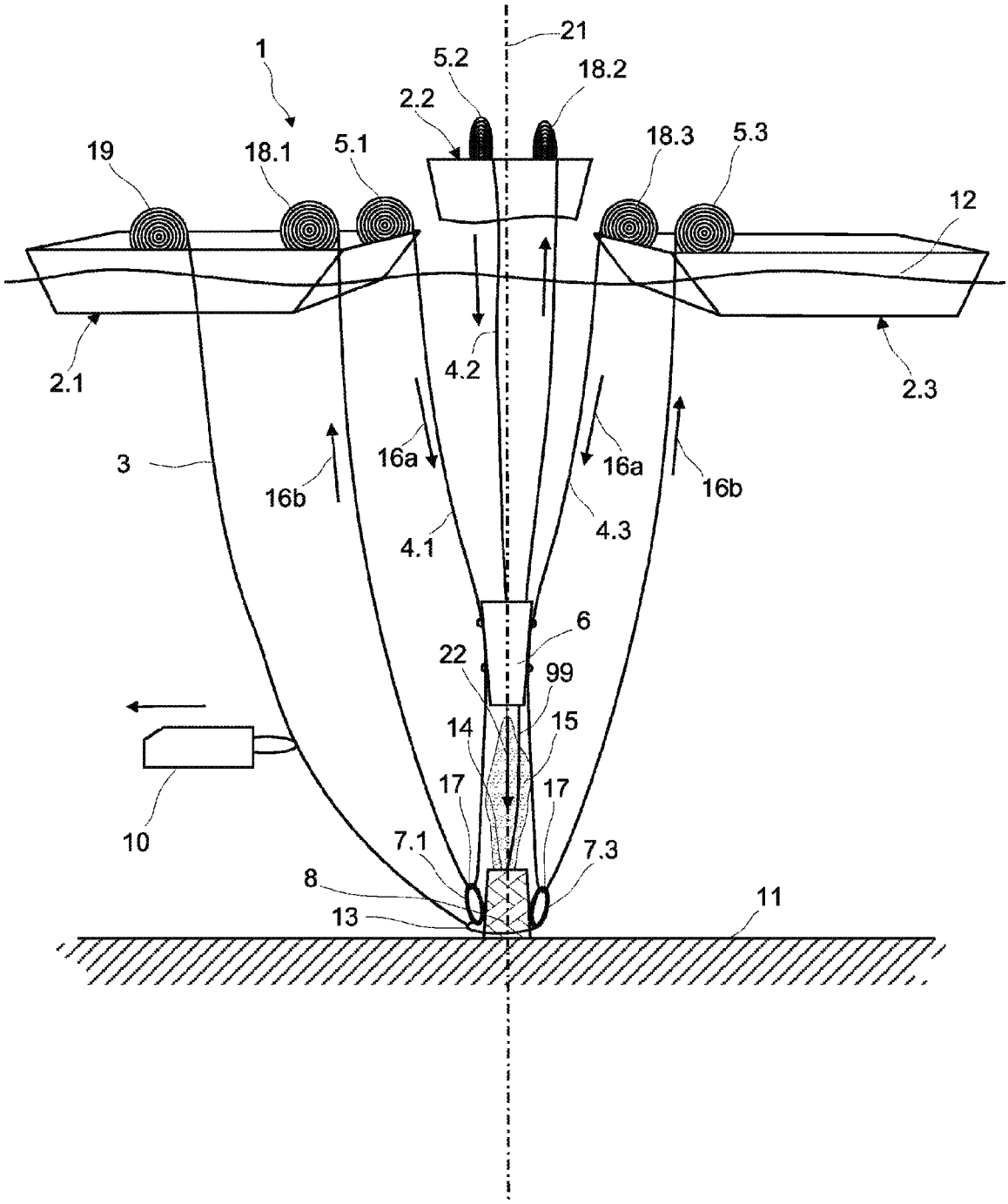
FIG. 1: a schematical view of the wellhead sealing arrangement according to the invention.

FIG. 1 shows a wellhead 8 from which oil 15 spills in an uncontrolled manner and under high pressure into the open sea. The wellhead 8 is located on the seabed 11 far below the sea level 12.

Three boats 2.1, 2.2, 2.3 are positioned above the wellhead 8 and laterally displaced from the wellhead 8. The virtual connection line between the boats form a triangle wherein the vertical line 21 passing through the wellhead 8 lies within this triangle. From one of these three boats 2.1 an anchoring cable 3 in the form of a steel wire lasso is taken down to the wellhead 8 by an ROV 10. On the steel wire lasso 3 three shackles 7.1, 7.2, 7.3 are fixed. The steel wire lasso 3 is placed by means of the ROV 10 around the wellhead 8 and pulled tight to the wellhead 8 to form a locking loop 13. The shackles 7.1, 7.2, 7.3 are attached to the locking loop 13 and hence are arranged close to the wellhead 8. The steel like lasso 3 is attached to the wellhead in a manner that the three shackles 7.1, 7.2, 7.3 are arranged around the circumference of the wellhead distanced from each other. Of course the shackles 7.1, 7.2, 7.3 are preferably arranged around the wellhead in equal or almost equal distances from each other. Of course, it is also possible that from each of the three boats an anchoring cable, each in the form of a steel wire lasso, and each with one shackle fixed on it is taken down and individually fixed on the wellhead 8 as above described (not shown in the figures).

Further, from each of the three boats 2.1, 2.2, 2.3 a guiding cable 4.1, 4.2, 4.3 each in the form of a steel wire is taken down to the wellhead 8 by an ROV 10. Each guiding cable 4.1, 4.2, 4.3 is looped, i.e. passed with its head end, through the corresponding shackle 7.1, 7.2, 7.3.

The shackles 7.1, 7.2, 7.3 form a point of reversal 17 for the guiding cables 4.1, 4.2, 4.3. The guiding cables 4.1, 4.2, 4.3 are now, with their head end side pulled upwards and back to the boat, e.g. also by means of an ROV. In return, additional guiding cable 4.1, 4.2, 4.3 is supplied on the lowering side 16*a* and passed through the shackle 7.1, 7.2, 7.3. Each guiding cable 4.1, 4.2, 4.3 now forms a kind of open loop with a reversal point 17 on the corresponding shackle 7.1, 7.2, 7.3. The reversal point 17 divides the guiding cable 4.1, 4.2, 4.3 into a pulling section 16*b*, where the guiding cable 4.1, 4.2, 4.3 is pulled upwards to the boat 2.1, 2.2, 2.3 and a lowering section 16*a*, where the guiding cable 4.1, 4.2, 4.3 is lowered to the wellhead 8.

Figure 2:
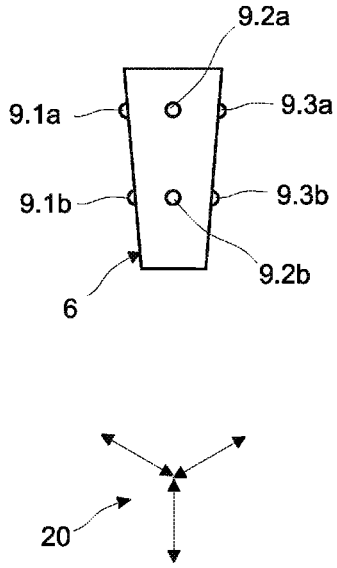
FIG. 2: a schematical view of the sealing element according to the invention.

A sealing element 6 in the form of a tapered plug is fastened to all three guiding cables 4.1, 4.2, 4.3 on the lowering section 16*a*. Each guiding cable 4.1, 4.2, 4.3 is attached to the plug 6 via an upper and lower fixing position 9.1*a*, 9.1*b*; 9.2*a*, 9.2*b*; 9.3*a*, 9.3*b* (only shown in FIG. 2). This way the plug 6 can be moved with six degrees of freedom 20. The fixing points are in the form of lugs 9.1*a*, 9.1*b*; 9.2*a*, 9.2*b*; 9.3*a*, 9.3*b*. The pairs of lugs 9.1*a*, 9.1*b*; 9.2*a*, 9.2*b*; 9.3*a*, 9.3*b* are arranged in distance, preferably in equal distances to each other around the circumference of the plug 6.

By pulling on the guiding cables 4.1, 4.2, 4.3 on the pulling section 16*b* and winding them up, the plug 6 is lowered together with the guiding cables 4.1, 4.2, 4.3 on their lowering section 16*a*.

By applying a variable pulling force between the guiding cables 4.1, 4.2, 4.3 the orientation of the plug 6 in the space can be changed. Once the plug 6 has reached the wellhead 8, it can be placed above the wellhead and can be at least partially inserted into the borehole by applying an adequate pulling force on the guiding cables 4.1, 4.2, 4.3 in order to seal off the wellhead. It is important that the reversal point 17 of the guiding cables 4.1, 4.2, 4.3 lies, when the sealing element is placed in its definitive sealing position, below or at the same height as the lowest fixing point 9.1*b*, 9.2*b*, 9.3*b* of the guiding cable 4.1, 4.2, 4.3 on the plug 6. In this way the plug 6 can be safely placed on the wellhead 8 as a vertical force 22 can be exerted on the plug 6 by means of the guiding cables 4.1, 4.2, 4.3 till the plug 6 is firmly positioned and fixed on, i.e. in the wellhead 8.

Once the plug 6 is fixed and secured on the wellhead 8 the guiding cables 4.1, 4.2, 4.3 and the anchoring cable 3 can be detached from the plug 6 and from the wellhead 8 and can be removed.

List Of Designations

1 Wellhead sealing arrangement
2.1 . . . 2.3 Boats
3 anchoring cable
4.1 . . . 4.3 guiding cables
5.1 . . . 5.3 Winches
6 Sealing element, Plug
7.1 . . . 7.3 Shackles
8 Wellhead
9.1*a* . . . 9.3*a* upper Lugs
9.1*b* . . . 9.2*b* lower Lugs
10 ROV
11 Seabed
12 Sea level
13 locking Loop
14 Well Opening
15 Oil
16*a* lowering section of the guiding cable
16*b* pulling section of the guiding cable
17 reversal point of the guiding cable
18.1 . . . 18.3 winches
19 winch
20 degrees of freedom
21 vertical line through the wellhead
22 vertical force

The invention claimed is:

1. A method for sealing an opening of a sub-sea wellbore at a wellhead, comprising the steps of:

placing and affixing at least one looped deflection element on or adjacent to the wellhead;

lowering a head end of at least one guiding cable from a first offshore vessel or platform above the wellhead in a first direction towards the wellhead;

threading the head end of the at least one guiding cable through the at least one looped deflection element, thereby slideably attaching the at least one guiding cable to the at least one looped deflection element, wherein the at least one looped deflection element forms a directional point of reversal for the head end of the at least one guiding cable and creates a boundary between a pulling section of the at least one guiding cable and a lowering section of the at least one guiding cable, wherein the pulling section of the cable extends from the at least one looped deflection element to the head end, wherein the lowering section is attached to the first offshore vessel or platform and extends from the first offshore vessel or platform to the at least one looped deflection element;

raising the head end of the at least one guiding cable, thereby allowing the pulling section of the at least one guiding cable to continue travel from the at least one looped deflection element in a second direction towards the first offshore vessel or platform while cable from the lowering section of the at least one guiding cable continues to be supplied from the first offshore vessel or platform toward the at least one looped deflection element;

connecting the head end of the at least one guiding cable to the first offshore vessel or platform;

lowering a sealing element, having at least one fixing point fastened to the lowering section of the at least one guiding cable, towards the wellhead by raising the pulling section of the at least one guiding cable in the second direction towards the first offshore vessel or platform;

continuing to raise the pulling section of the at least one guiding cable until the sealing element is placed in a sealing position on the opening of the wellhead and the wellbore is sealed with the sealing element.

2. A method according to claim 1, wherein the at least one looped deflection element is a shackle.

3. A method according to claim 1, wherein when the sealing element is placed in the sealing position, the directional point of reversal formed by the at least one looped deflection element is at a lower or at an equivalent height than a lowest of the at least one fixing point fastened to the lowering side of the at least one guiding cable.

4. A method according to claim 1, wherein the first offshore vessel or platform is a boat, a working platform, or an offshore platform.

5. A method according to claim 1, wherein the at least one guiding cable is made of metal.

6. A method according to claim 1, further comprising the steps of:

lowering an anchoring cable with the at least one looped deflection element fastened on it from an offshore vessel or platform above the wellhead, in a direction of the wellhead;

fastening the anchoring cable on the wellhead or on another device near the wellhead or anchoring the anchoring cable in a seabed adjacent to the wellhead, thereby placing and fixing the at least one looped deflection element close to the wellhead.

7. A method according to claim 6, wherein the anchoring cable is a steel wire lasso fastened by means of one or more ROVs, placing the steel wire lasso around the wellhead and pulling the steel wire lasso tight to the wellhead to form a locking loop, whereby the locking loop of the anchoring cable has at least one looped element attached.

8. A method according to claim 1, wherein the sealing element is placed on the opening of the wellhead by inserting the sealing element into a borehole of the wellhead.

9. A method according to claim 1, comprising the step of:

lowering an anchoring cable to the wellhead or to another device near the wellhead or anchoring the anchoring cable in a seabed, and placing and fixing the at least one looped deflection element close to the wellhead by means of one or more remotely operated underwater vehicles (ROV).

10. A method according to claim 1, wherein the step of:

threading the head end of the at least one guiding cable through the at least one looped deflection element and raising the head end of the at least one guiding cable is completed by means of one or more remotely operated underwater vehicles (ROV).

11. A method according to claim 1, wherein the sealing element is a plug which is tapered towards the wellhead.

12. A method according to claim 1, wherein the pulling section of the at least one guiding cable is pulled upward at its head end side by means of a winch, located on the first offshore vessel or platform.

13. A method according to claim 12, wherein the first offshore vessel or platform is a boat and wherein the winch is located on the boat, and wherein the winch is a heave compensation winch for eliminating or reducing an effect of movement of the boat on position and orientation of the sealing element.

14. A method according to claim 1, wherein the sealing element comprises a passage on which a pipe can be attached outside the wellhead, and through which, when the sealing element is in the sealing position on the wellhead, oil, gas, or oil and gas can be discharged in a controlled manner.

15. The method according to claim 1, wherein:

at least one winch device lowers the lowering section of the at least one guiding cable and raises the pulling section of the at least one guiding cable.

16. A method according to claim 1, wherein the at least one guiding cable is made of steel.

17. A method for sealing an opening of a sub-sea wellbore at a wellhead, comprising the steps of:

placing and affixing a plurality of looped deflection elements radially around the wellhead;

lowering a head end of each of a plurality of guiding cables from a plurality of offshore vessels or platforms above the wellhead in a first direction towards the wellhead;

threading the head end of each of the plurality of guiding cables though a respective one of the plurality of looped deflection elements, thereby slideably attaching each of the plurality of guiding cables to the respective looped deflection elements, wherein the plurality of deflection elements form directional points of reversal for the head ends of the plurality of guiding cables and create a boundary between a pulling section of each of the plurality of guiding cables and a lowering section of each of the plurality of guiding cables, wherein the pulling section of each of the plurality of guiding cables extend from the respective one of the plurality of looped deflection elements to the head end of each of the plurality of guiding cables, wherein the lowering section of the plurality of guiding cables is attached to the plurality of offshore vessels or platforms and extends from the plurality of offshore vessels or platforms to the plurality of looped deflection elements;

raising the head end of each of the plurality of guiding cables, thereby allowing the pulling section of each of the plurality of guiding cables to continue travel from each of the plurality of looped deflection elements in a second direction towards the plurality of offshore vessels or platforms while cable from the lowering section of the plurality of guiding cables continues to be supplied from the plurality of offshore vessels or platforms towards the plurality of looped deflection elements;

connecting the head end of each of the plurality of guiding cables to one of the plurality of offshore vessels or platforms;

lowering a sealing element, said sealing element having a plurality of fixing points, each of the plurality of fixing points fastened to the lowering section of each of the plurality of guiding cables, wherein the plurality of fixing points of the sealing element are radially spaced around the sealing element;

continuing to raise the pulling section of each of the plurality of guiding cables until the sealing element is placed in a sealing position on the opening of the wellhead and the wellbore is sealed with the sealing element.

18. A method according to claim 17, wherein the plurality of the fixing points comprises a first fixing point fastened to the lowering section of a first of the plurality of guiding cables, a second fixing point fastened to the lowering section of a second of the plurality of guiding cables, and a third fixing point fastened to the lowering section of a third of the plurality of guiding cables, wherein the first, second, and third fixing points of the sealing element are radially spaced around the sealing element;

the sealing element further comprising a fourth, fifth, and sixth fixing points fastened to the lowering section of the first, second, and third of the plurality of guiding cables, the fourth, fifth, and sixth fixing points radially spaced around the sealing element above the first, second, and third fixing point.

19. A method according to claim 18, wherein the plurality of fixing points are defined by lugs which are attached to the sealing element.

20. A method according to claim 18, wherein the first, second, and third fixing points are paired with the fourth, fifth, and sixth fixing points, and are arranged at equal distances from each other in a circumferential direction around the sealing element.

21. A method according to claim 18, further comprising the step of guiding and aligning the sealing element with the first, second, third, fourth, fifth, and sixth fixing points, thereby allowing for six degrees of freedom for controlling position and orientation of the sealing element.

22. An apparatus for sealing an opening of a sub-sea wellbore at a wellhead, comprising:

at least one offshore vessel or platform positioned above the wellhead;

at least one looped deflection element positioned on or adjacent to the wellhead;

at least one guiding cable threaded through the at least one looped deflection element, said at least one guiding cable comprising a head end, a pulling section, and a lowering section;

wherein the pulling section extends from the looped deflection element to the head end, wherein the lowering section extends from the offshore vessel or platform to the looped deflection element, wherein the head end of the at least one guiding cable is connected to one of the at least one offshore vessel or platform and wherein the lowering section of the at least one guiding cable is connected to one of the at least one offshore vessel or platform; and a sealing element comprising at least one fixing point, said at least one fixing point fastened to the at least one guiding cable at a first location on the lowering section of the at least one guiding cable.

23. The apparatus of claim 22, wherein the at least one looped deflection element is attached to the wellhead.

24. The apparatus of claim 22 wherein the at least one offshore vessel or platform comprises at least one winch device, and wherein the head end is connected to the at least one winch device and the lowering section is connected to the at least one winch device.

25. The apparatus of claim 22 wherein the at least one looped deflection element is a plurality of looped deflection elements, wherein the plurality of looped deflection elements are positioned radially around the circumference of the wellhead at a distance from each other, wherein the at least one guiding cable is a plurality of guiding cables, each comprising a head end, a pulling section, and a lowering section, wherein each of the plurality of guiding cables is threaded through one of the plurality of looped deflection elements, wherein each of the pulling sections of the plurality of guiding cables is connected to one of the at least one offshore vessels or platforms by a winch, wherein each of the lowering sections of the plurality of guiding cables is attached to one of the at least one offshore vessels or platforms by a winch, wherein the at least one fixing point of the sealing element is a plurality of fixing points radially spaced around the sealing element, wherein each of the plurality of fixing points is attached to one of the plurality of guiding cables at a first location on each of the plurality of guiding cables, said first location being on the lowering section of each of the plurality of guiding cables.

26. The apparatus of claim 22 wherein the at least one looped deflection element is a shackle.

27. The apparatus of claim 22 wherein the wellhead comprises an opening and wherein the sealing element is positioned on the opening of the wellhead.

* * * * *